US007191504B1

(12) United States Patent
Charron

(10) Patent No.: US 7,191,504 B1
(45) Date of Patent: Mar. 20, 2007

(54) UNIVERSAL BUSHING TOOL AND METHOD OF USE

(75) Inventor: Paul C. Charron, Waitsfield, VT (US)

(73) Assignee: Sonnax Industries, Inc., Bellows Falls, VT (US)

( * ) Notice: Subject to any disclaimer, the term of this patent is extended or adjusted under 35 U.S.C. 154(b) by 0 days.

(21) Appl. No.: 11/388,659

(22) Filed: Mar. 23, 2006

Related U.S. Application Data

(60) Provisional application No. 60/664,467, filed on Mar. 24, 2005.

(51) Int. Cl.
*B25B 27/1411* (2006.01)

(52) U.S. Cl. ..... 29/278; 29/255; 29/270

(58) Field of Classification Search ..... 29/278, 29/270, 275, 261–263, 256, 255
See application file for complete search history.

(56) References Cited

U.S. PATENT DOCUMENTS

| | | | | |
|---|---|---|---|---|
| 1,381,101 A | | 6/1921 | Albertson | |
| 2,646,619 A | | 7/1953 | McCord | 29/263 |
| 4,339,865 A | | 7/1982 | Schultz | 29/525 |
| 4,724,608 A | | 2/1988 | Parrott | 29/724 |
| 5,025,542 A | | 6/1991 | Jacks | 29/252 |
| 5,090,102 A | * | 2/1992 | Lovell | 29/255 |
| 5,355,574 A | * | 10/1994 | Zweekly et al. | 29/262 |
| 5,509,186 A | | 4/1996 | Straut | 29/256 |
| 5,528,809 A | | 6/1996 | Green et al. | 29/275 |
| 5,898,985 A | | 5/1999 | Villarreal | 29/257 |
| 6,212,775 B1 | | 4/2001 | Sarver et al. | 29/898.08 |
| 6,591,469 B1 | * | 7/2003 | Morin | 29/402.08 |

* cited by examiner

*Primary Examiner*—Lee D. Wilson
(74) *Attorney, Agent, or Firm*—Clifford F. Rey

(57) ABSTRACT

A universal bushing tool for removing bushings of various diameters from machine assemblies is disclosed. The present tool comprises a handle, a plurality of interchangeable handle extensions, a plurality of sets of interchangeable wedge segments, and a plurality of interchangeable pilot studs which are mechanically attached to the handle extension. In a method of the present invention, a set of wedge segments is selected based on the diameter of bushing to be removed. Next, a handle extension of an appropriate length is selected based on location and access to the bushing. Next, a pilot stud of an appropriate diameter for the size of the wedge segments to be used for removing the bushing is selected. Thereafter, the wedge segments are arranged at 90° intervals about the pilot stud and captured between the pilot stud and the handle extension and tightened retaining the wedge segments in a disc-shaped configuration.

18 Claims, 8 Drawing Sheets

UNIVERSAL BUSHING TOOL AND METHOD OF USE

CROSS-REFERENCE TO RELATED APPLICATION

This application claims the benefit under 35 U.S.C.§ 119(e) of U.S. Provisional Patent Application No. 60/664,467 filed Mar. 24, 2005, entitled Universal Bushing Tool and Method of Use.

BACKGROUND OF THE INVENTION

The present invention relates generally to special purpose tools and, more particularly, to a universal bushing tool for manually removing and/or installing bushings from automotive transmission components and other machine assemblies.

During a transmission overhaul, engine rebuild, or other similar repair procedure it is often necessary to remove and replace original equipment manufacture bushings within transmission cases and other machine assemblies. These original equipment manufacture (hereinafter "OEM") bushings are typically pressed into a shouldered or so-called blind bore at the factory with an interference fit. Once installed such bushings are difficult to accurately remove and replace without the factory tooling.

During subsequent service operations such factory-installed bushings are often damaged by mechanics using a makeshift tool, or, alternatively, the worn bushing may be left in place leaving excessive clearance with the mating shaft resulting in a substandard repair.

DESCRIPTION OF PRIOR ART

Many bushing removal tools or so-called bushing pullers for extracting bushings from machine housings are known in the prior art. One example of such a tool is disclosed in U.S. Pat. No. 1,381,101 which illustrates a bushing puller for removal of bushings from various pieces of apparatus with minimal tooling requirements making it comparatively economical to manufacture. This bushing remover comprises a tapered tap member having an internally threaded bore and a jack screw with a cross bar handle for co-acting with threads of the bore. To remove a bushing, the tapered tap member is initially engaged in the bushing using the cross bar handle. Thereafter, the handle is reversed and the jack screw is threadably advanced into the internal threads of the tap member until it bottoms out in the bore. Further rotation of the handle forces the bushing out of the bore.

U.S. Pat. No. 2,646,619 granted to McCord describes a bushing remover tool that includes a plurality of so-called bushing contacting dogs that are flexibly biased radially such that the dogs can be initially disposed behind a bushing by compressing the tool radially inward. Thereafter, the dogs are spread behind the bushing when the tool is inserted to the proper depth. This serves to center the tool so that a pull screw can be used to impart an axial force for removal of the bushing.

U.S. Pat. No. 4,339,865 granted to Shultz discloses an apparatus and method for inserting and removing bushings and bearings. The apparatus includes an elongated driving shaft; a bushing driving mandrel; a mandrel spreader; and a depth stop sleeve used only for insertion. The mandrel is formed from a plurality of annular segments expandably held together with a plurality of elastomeric O-rings. The mandrel also includes a bushing contacting shoulder on each expandable segment to transmit force from the driving shaft, through the driving shaft shoulder, through the mandrel rear shoulder, and through the bushing shoulders for insertion or removal.

Ronald J. W. Parrott was granted U.S. Pat. No. 4,724,608 for a puller for spherical bushings that comprises an inner puller body having a cylindrical outer surface so that it can be inserted into the bore of the bushing with a lip at one end for engaging the bushing. A wedge member actuated by an elongate bolt forces the lip outwardly to engage the bushing.

U.S. Pat. No. 6,591,469 granted to Morin discloses a special purpose tool for manual installation and removal of bushings or sleeve bearings from press fit bearing housings within automotive engines, transmissions, and other machinery with no resultant damage to the housing. The tool can also be utilized to manually install new bushings into housings and other components.

Other known prior art bushing removal tools include U.S. Pat. No. 5,025,542 to Jacks; U.S. Pat. No. 5,509,186 to Straut; U.S. Pat. No. 5,528,809 to Green et al.; U.S. Pat. No. 5,898,985 to Villarreal; U.S. Pat. No. 6,212,775 to Sarver et al; and U.S. Statutory Invention Registration No. H1349 to Kelley.

While these devices fulfill their particular objectives and requirements, the aforementioned patents do not disclose a Universal Bushing Tool and a Method of Use in the manner of the present invention.

SUMMARY OF THE INVENTION

The present invention is a universal bushing tool and method of use for removal and/or installation of bushings of various diameters from transmission cases and other machine assemblies. The present universal bushing tool comprises a handle, a plurality of interchangeable handle extensions of different dimensions for use on various bore diameters and bore lengths, a plurality of sets of interchangeable wedge segments for various diameters of bushings, and a plurality of interchangeable pilot studs of different dimensions, which are mechanically attached to the handle extension.

In a method of the present invention, a set of wedge segments is selected based on the diameter of bushing to be installed and/or removed from the transmission or other machine assembly. Next, a handle extension of an appropriate length is selected based on the location and available access to the bushing. Next, a pilot stud of an appropriate diameter for the size of the wedge segments to be used for removing the bushing is selected. Thereafter, the wedge segments are arranged at 90° intervals around the smallest diameter of the pilot stud and secured between the pilot stud and the handle extension retaining the wedge segments in their functional position.

In some instances it may be necessary to initially place the handle extension with the pilot stud loosely attached into the bore wherein the bushing is located and then to manually insert the wedge segments one at a time into position behind the bushing. Thereafter, the pilot stud is tightened down using the cap screw to secure the wedge segments in their functional position.

In such instance the bushing can be manually pushed out of its installed position or, alternatively, pulled out of its installed position depending on the configuration of the transmission case and the available access to the bushing. In some applications the present tool may also be used to install a new bushing using essentially the same method in reverse.

In an alternative embodiment the present tool is provided in a simplified form wherein the handle and the handle extension are provided as a unitary construction for removal of a specific bushing within a transmission case in a production line setting.

BRIEF DESCRIPTION OF THE DRAWINGS

The novel features of the present invention are set forth in the appended claims. The invention itself, however, as well as other features and advantages thereof will be best understood by reference to the following detailed description of an illustrative embodiment when read in conjunction with the accompanying figures, wherein:

DETAILED DESCRIPTION OF THE INVENTION

Figure 1:
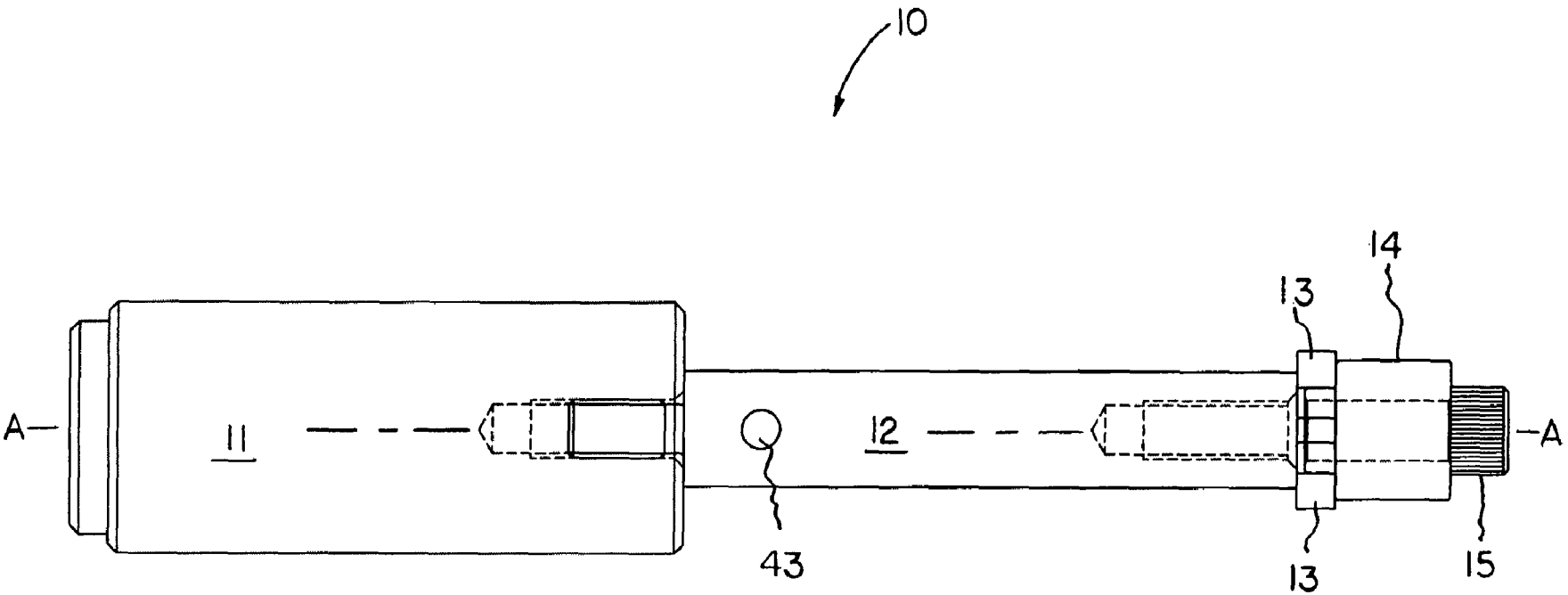
FIG. 1 is an elevational view of the universal bushing tool of the present invention.

With further reference to the drawings there is shown therein a universal bushing tool embodying the principles and concepts of the present invention, illustrated in FIG. 1 and indicated generally at 10. The present bushing tool assembly 10 comprises a handle 11, a plurality of interchangeable handle extensions 12, 12' (FIGS. 3A–3B) of different dimensions for use on various transmission cases, a plurality of sets of interchangeable wedge segments 13, 13', a plurality of interchangeable pilot studs 14, 14', and a cap screw 15 for attachment of wedge segments 13, 13' and pilot studs 14, 14' to a handle extension 12, 12'. It will be understood that when the present tool 10 is assembled, each of the above components is disposed in concentric relation to longitudinal axis -A- as shown in FIG. 1.

Figure 2:
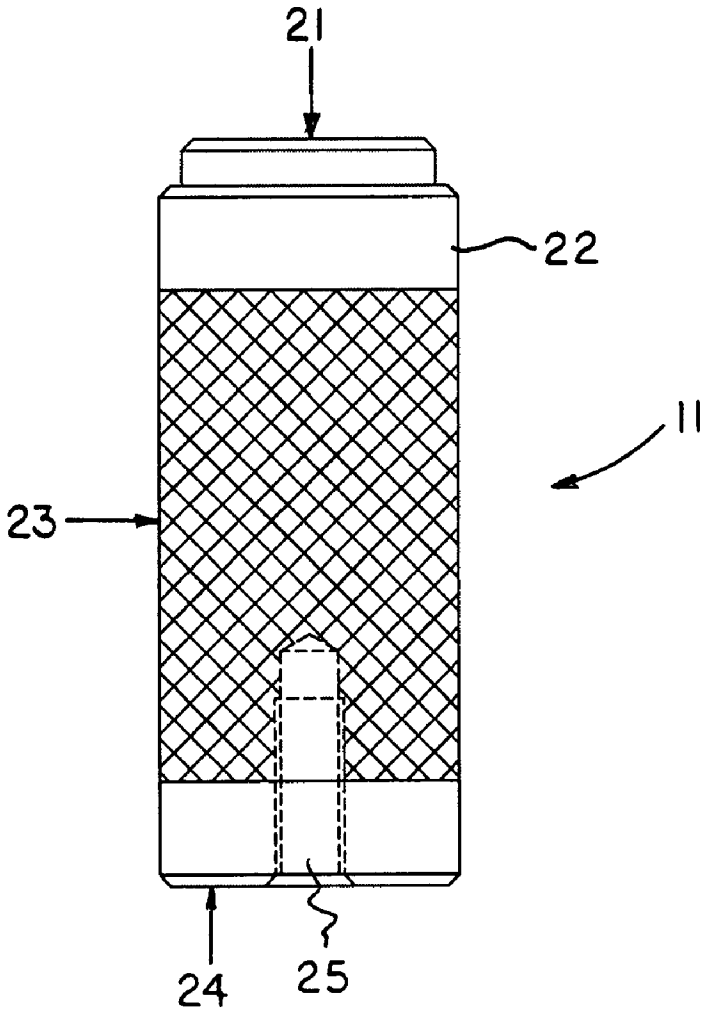
FIG. 2 is an elevational view of a handle member of the present universal bushing tool showing details thereof.

Referring to FIG. 2 handle 11 comprises an elongated, cylindrical shaft having a body member 22 with a knurled gripping surface as at 23, a driven end 21, and a receiving end 24. The receiving end 24 of the body 22 includes a threaded hole 25 for engagement with a mating threaded member 41 on handle extensions 12, 12'.

Figure 3B:
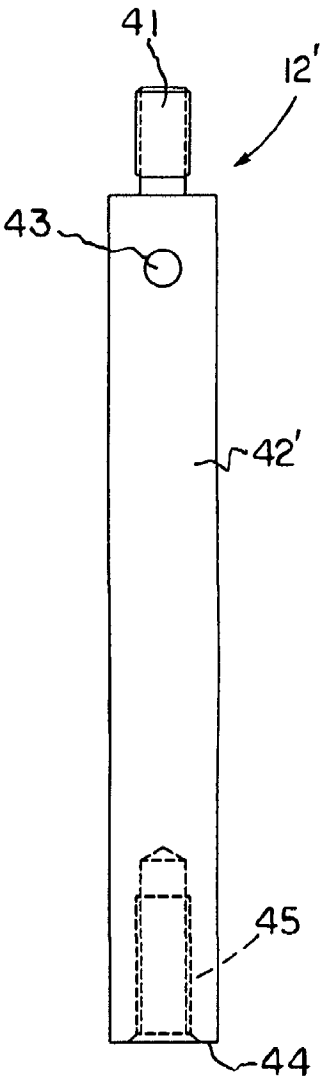
FIG. 3B is an elevational view of another embodiment of a handle extension member of the present universal bushing tool.
Figure 3A:
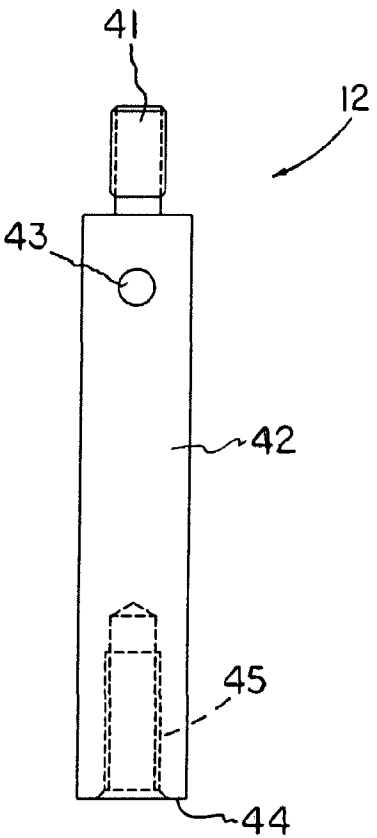
FIG. 3A is an elevational view of a handle extension member of the universal bushing tool showing details thereof.

With reference to FIGS. 3A–3B there is shown therein a plurality of interchangeable handle extension members 12, 12' each including a main shaft 42 having such a mating threaded member 41 formed at a proximal end thereof. Extension members 12, 12' include a threaded hole 45 at a distal end 44 thereof for receiving cap screw 15. Extension members 12, 12' also include a cross hole 43 extending therethrough for receiving a pin or other tool such as a screwdriver (not shown), which is used to loosen and/or tighten the extension members 12, 12' to a predetermined torque at their threaded connection to the handle member 11.

In the present invention the outside diameter of the distal ends 44 and the axial length of the shafts 42, 42' of the interchangeable extension members 12, 12' respectively are varied according to the location and available access to the bushing to be removed. Accordingly, the total length of a given extension member 12, 12' is also varied to accommodate these requirements. Representative diameters for extension members 12, 12', axial lengths of extension member shafts 42, 42', and total lengths of extension members 12, 12' in accordance with the present invention are listed in Table 1 as shown hereinbelow. However, it will be appreciated by those skilled in the art that alternative dimensional parameters may also be utilized for a given application of the present tool 10.

TABLE 1

Range of dimensions for handle extension members

| Item No. | Diameter of extension member (inch) | Length of extension member shaft (inch) | Total length of extension member (inch) |
|---|---|---|---|
| 1. | .625 ± .005 | 4.0 ± .03 | 4.75 ± .03 |
| 2. | .625 ± .005 | 2.5 ± .03 | 3.25 ± .03 |
| 3. | .750 ± .005 | 4.0 ± .03 | 4.75 ± .03 |
| 4. | .750 ± .005 | 2.5 ± .03 | 3.25 ± .03 |
| 5. | 1.0 ± .005 | 4.0 ± .03 | 4.75 ± .03 |
| 6. | 1.0 ± .005 | 2.5 ± .03 | 3.25 ± .03 |

Figure 4A:
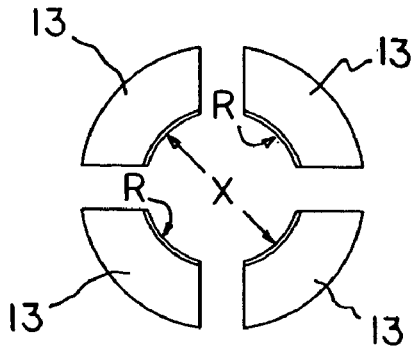
FIG. 4A is a plan view of a set of interchangeable wedge segments for the present universal bushing tool.
Figure 4B:
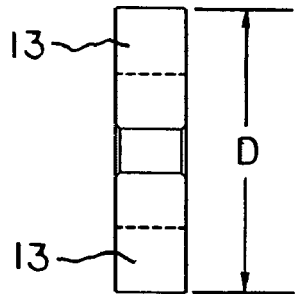
FIG. 4B is a side elevation of the set of interchangeable wedge segments of FIG. 4A shown rotated 90 degrees from the position in FIG. 4A.
Figure 4C:
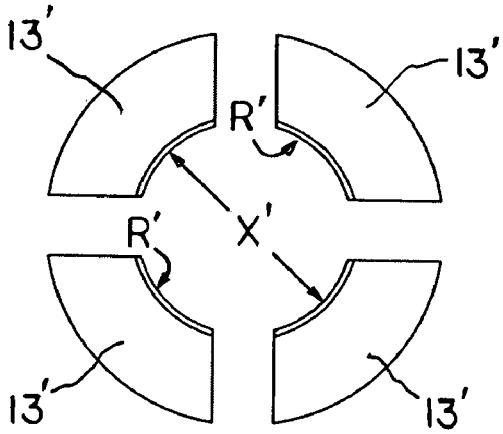
FIG. 4C is a plan view of an alternative set of interchangeable wedge segments for the present universal bushing tool.
Figure 4D:
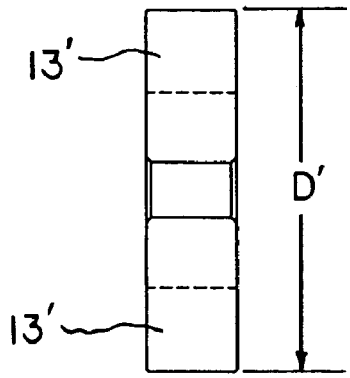
FIG. 4D is a side elevation of an alternative set of interchangeable wedge segments of FIG. 4C shown rotated 90 degrees from the position in FIG. 4C.

In the present invention a plurality of sets of interchangeable wedge segments 13, 13' (shown in FIGS. 4A–4B) for tools 10, 10' are selectively employed based on the diameter of the bushing 55 to be removed. Each set of interchangeable wedge segments 13, 13' comprises four individual wedge segments, which define a 90 degree sector of a circle. Each wedge segment 13, 13' includes an inside radius -R-, -R'- coincident with the 90 degree angle defining each sector. The inside radii -R-, -R'- reside on pilot diameters 71, 71' respectively of pilot studs 14, 14' (FIGS. 5A–5B) when assembled. When so assembled wedge segments 13, 13' form a disc-shaped subassembly having an effective outside diameter -D- or -D'- as shown in FIGS. 4B and 4D. Wedge segments 13, 13' are disposed in concentric relation to axis -A- and are captured intermediate pilot stud 14, 14' and handle extension 12, 12' by advancing the cap screw 15 into threaded hole 45.

Figure 5A:
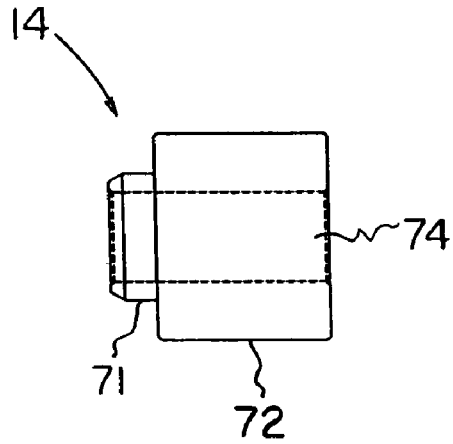
FIG. 5A is an elevational view of a pilot stud of the present universal bushing tool.
Figure 5B:
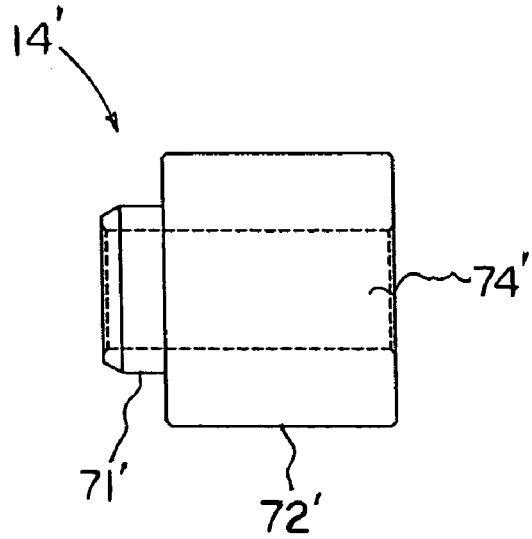
FIG. 5B is an elevational view of another embodiment of a pilot stud of the present universal bushing tool.

In the present tool 10 the outside diameters -D- or -D'- of the subassembly of wedge segments 13, 13' corresponds generally to the outside diameter of the bushing 55 to be removed. The present bushing tool 10 is designed for use with bushings 55 in the range of Ø0.500 to Ø1.500 or even larger. An effective inside diameter -X- or -X'-defined by the assembled wedge segments 13, 13' conforms to pilot diameters 71, 71' of the pilot studs 14, 14' respectively as shown in FIGS. 5A–5B.

In the present invention a plurality of interchangeable pilot studs 14, 14' are provided with tool 10. Each pilot stud 14 is a cylindrical structure comprising a pilot diameter 71, 71' and body member 72, 72' having an axial bore 74, 74' extending therethrough. The largest outside diameter of the pilot studs 14, 14' to be utilized generally corresponds to, but is somewhat less than, the effective diameter -D- or -D'- of wedge segments 13, 13' to be employed during bushing removal/installation.

In the preferred embodiment each of the above-enumerated components including handle 11, handle extensions 12, 12', wedge segments 13, 13', and pilot studs 14, 14' are fabricated of low carbon steel or other suitable material to enhance durability.

Figure 6:
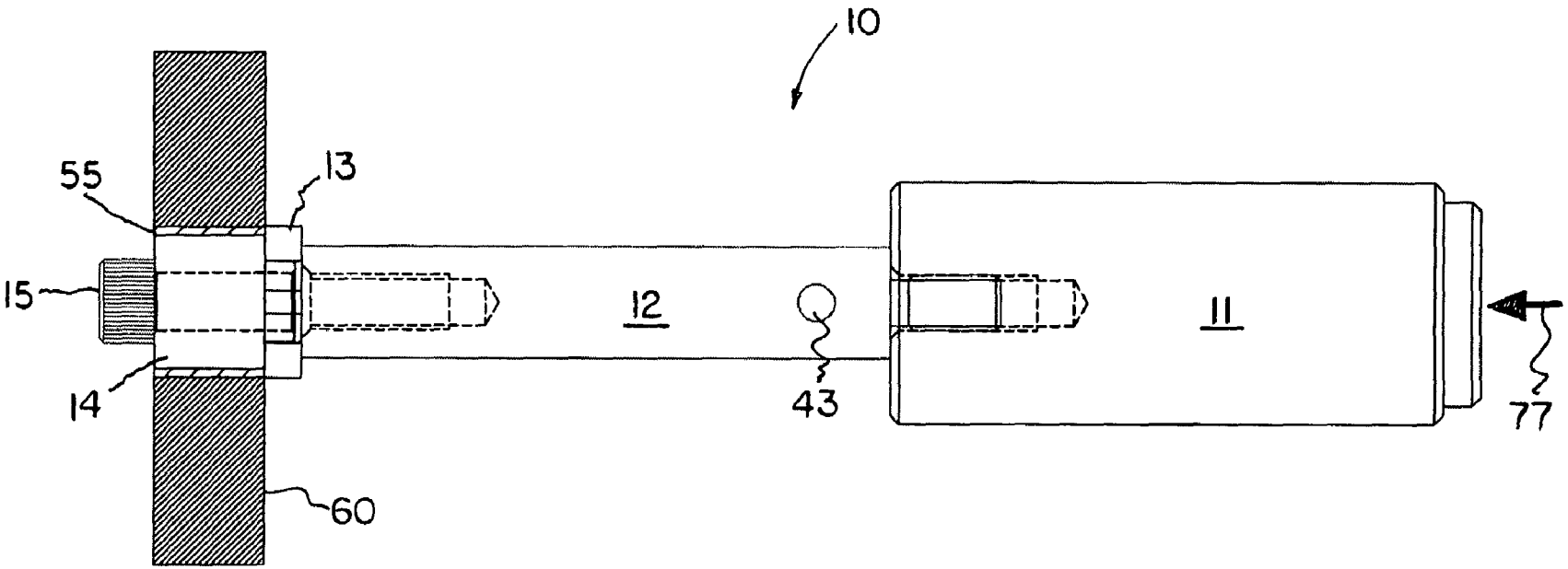
FIG. 6 is an elevational view showing the present universal tool inserted in a workpiece (i.e. in cross-section) during a bushing removal procedure.

In a method of the present invention, a set of wedge segments 13 or 13' is selected based on the diameter of bushing 55 to be removed within a transmission case 60 or other machine assembly (see FIG. 6). Next, a handle extension 12 or 12' of appropriate dimensions is selected based on the location and access to the bushing 55. Next, a pilot stud 14, 14' of an appropriate diameter for the size of the wedge segments 13, 13' to be used for removing a bushing is selected. Thereafter, the wedge segments 13, 13' are arranged at 90° intervals as shown (FIG. 1) around a pilot diameter 71, 71' of a pilot stud 14, 14' in a disc-shaped configuration and the pilot stud is disposed in coaxial, end-to-end relation to the distal end of handle extension member 12, 12'. Cap screw 15 is inserted through bore 74 in pilot stud 14, 14' and tightened to retain wedge segments 13, 13' in their functional position. Thereafter, the tool assembly 10 is positioned as shown in FIG. 6 and an axial force (as shown by directional arrow 77) is applied with an appropriate striking tool such as a hammer (not shown) to remove the bushing 55.

In a similar manner it will be appreciated by those skilled in the art that a new bushing 55 may be installed within a transmission case 60 or other machine assembly using the present tool 10 depending upon the interference fit (and degree of axial force to be applied) against the bushing 55 during installation.

Figure 7:
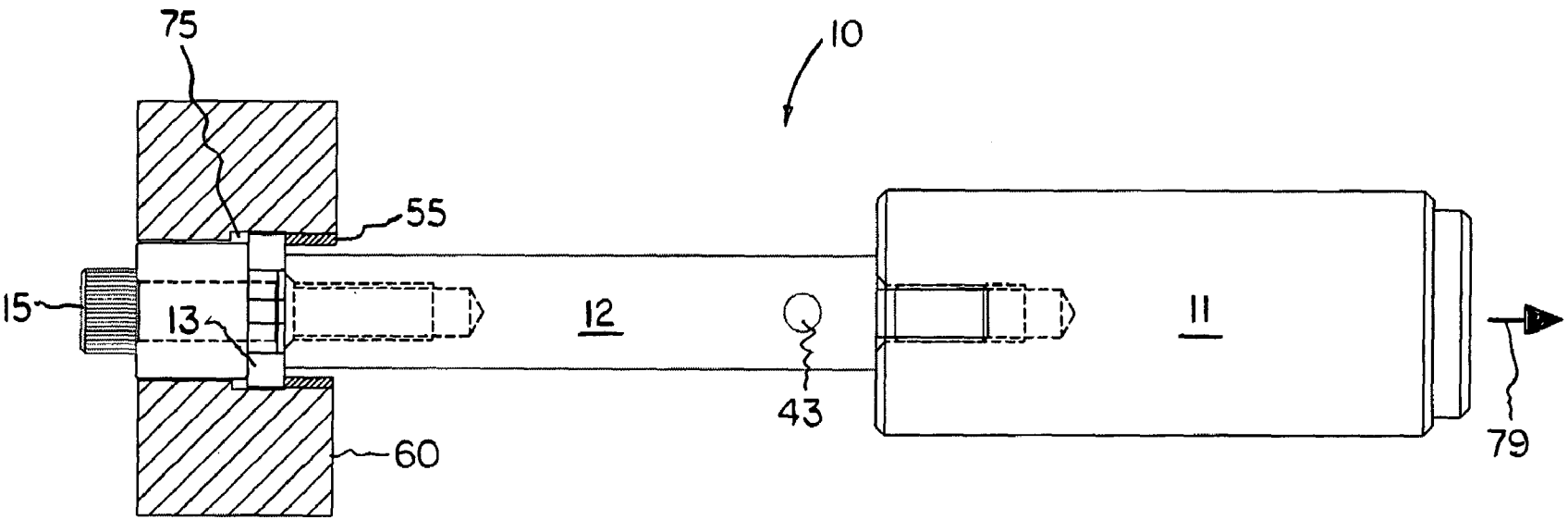
FIG. 7 is an elevational view of the present universal bushing tool showing the present tool being used in another bushing removal procedure.

In some applications it may be necessary to first insert the handle extension 12, 12' with a pilot stud 14, 14' loosely attached thereto into the bore 75 wherein the bushing 55 is located and then manually insert a set of wedge segments 13, 13' one at a time into position behind the bushing 55 (FIG. 7). Thereafter, pilot stud 14, 14' is tightened against wedge segments 13, 13' using the cap screw 15 to secure the wedge segments in the position shown in FIG. 7. Using this technique the bushing 55 can be manually pulled out of its installed position (as shown by directional arrow 79) or, alternatively, driven out of its installed position depending on the configuration of the component 60 and the available access to the bushing 55.

Figure 8:
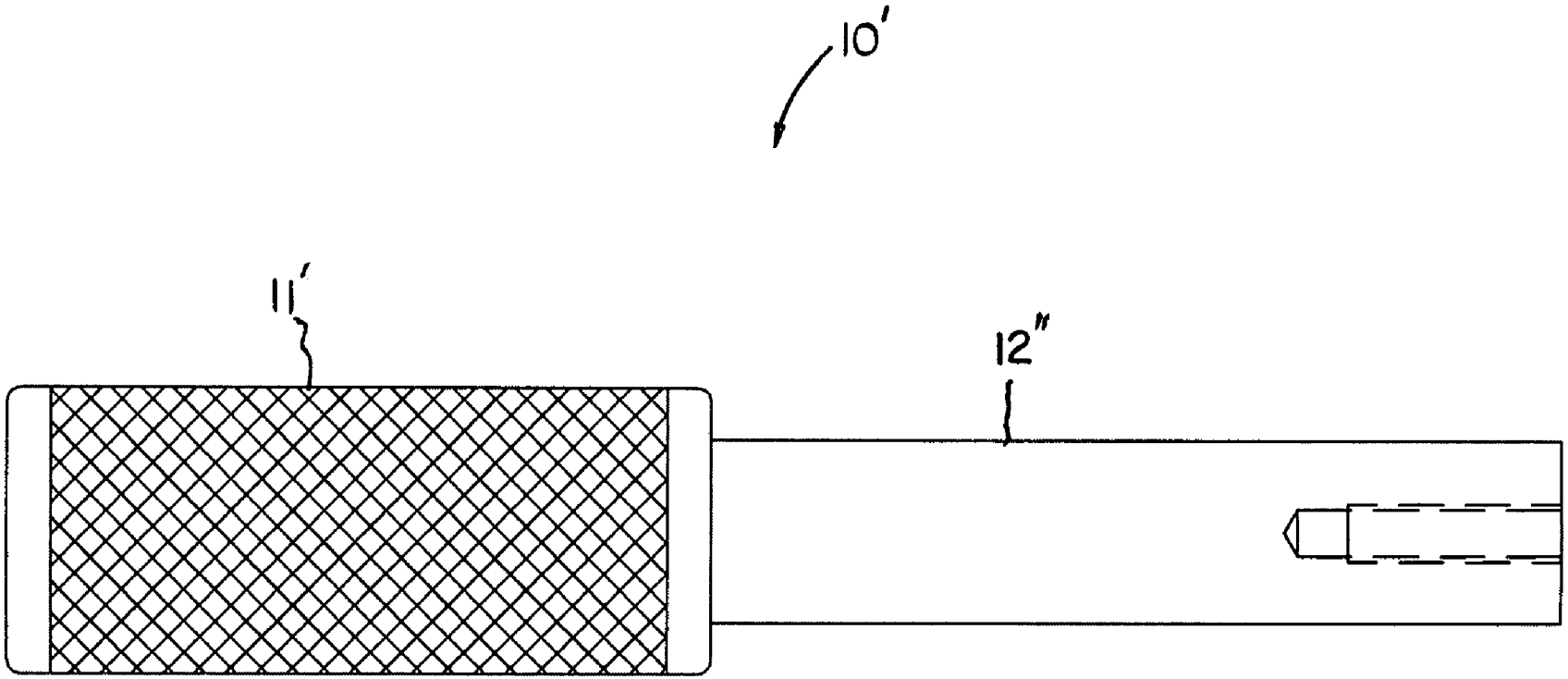
FIG. 8 is an elevational view of an alternative embodiment of the present universal bushing tool wherein the handle member and handle extension member are a unitary construction.

In an alternative embodiment of the present bushing tool 10', the handle 11' and handle extension member 12" are fabricated as a unitary construction as shown in FIG. 8. In this embodiment tool 10' is designed for production use with a specific bushing or bushings wherein such bushing is routinely replaced during a rebuild procedure. Thus, only a single set of wedge segments 13, 13' and a single pilot stud 14, 14' of predetermined dimensions are typically provided for this version of the tool 10'. It will also be noted that a cross hole 43 is omitted in this version of the present tool 10' in the absence of any threaded connection between interchangeable handle extension members 12, 12' provided in the previous embodiment as described hereinabove.

Although not specifically illustrated in the drawings, it should be understood that additional equipment and structural components will be provided as necessary and that all of the components described above are arranged and supported in an appropriate fashion to form a complete and operative universal bushing tool and method of use incorporating features of the present invention.

Moreover, although illustrative embodiments of the invention have been described, a latitude of modification, change, and substitution is intended in the foregoing disclosure, and in certain instances some features of the invention will be employed without a corresponding use of other features. Accordingly, it is appropriate that the appended claims be construed broadly and in a manner consistent with the scope of invention.

Having described preferred embodiments of our invention, what we desire to secure by U.S. Letters Patent is as follows:

What is claimed is:

1. A universal bushing tool comprising:

a handle member having a longitudinal axis, wherein said handle member includes a first end and a second end;

at least one interchangeable handle extension for attachment to said handle member, wherein said handle extension includes a proximal end and a distal end;

at least one interchangeable pilot stud having a pilot diameter, wherein said pilot stud further includes a longitudinal bore, said pilot stud being disposed in end-to-end relation to said at least one interchangeable handle extension;

a cap screw extending through said bore within said pilot stud, wherein said cap screw engages mating threads formed in said handle extension; and at least one set of interchangeable wedge segments, wherein said wedge segments are captured intermediate said pilot stud and said handle extension by advancing said cap screw into said mating threads formed in said handle extension.

2. A universal bushing tool of claim 1 wherein said handle member includes a threaded hole formed at said second end thereof, wherein said threaded hole is concentric to said longitudinal axis.

3. A universal bushing tool of claim 2 wherein said handle member includes a knurled gripping surface.

4. A universal bushing tool of claim 2 wherein said at least one interchangeable handle extension includes a threaded member projecting from said proximal end thereof for engagement within said threaded hole formed in said handle member.

5. A universal bushing tool of claim 4 wherein said at least one interchangeable handle extension further includes a threaded hole formed at said distal end thereof for engagement with said cap screw.

6. A universal bushing tool of claim 2 wherein said at least one set of interchangeable wedge segments includes four of said wedge segments, wherein said wedge segments are radially disposed about said pilot stud at ninety-degree intervals in a disc-shaped configuration.

7. A universal bushing tool of claim 6 wherein each of said wedge segments includes an inside radius formed thereon, wherein said inside radius is configured for mating engagement with said pilot diameter.

8. A universal bushing tool of claim 1 wherein said handle extension includes a cross hole extending therethrough at a predetermined axial location.

9. A method of removing a bushing from a machine assembly utilizing a bushing removal tool, wherein said bushing removal tool comprises a handle member, at least one interchangeable handle extension member having a threaded projection formed thereon at a proximal end and a threaded hole formed at a distal end thereof, wherein said handle extension member further includes a cross-hole drilled therein, at least one interchangeable pilot stud having a pilot diameter formed thereon, wherein said pilot stud further includes a longitudinal bore, at least one cap screw, and at least one set of interchangeable wedge segments, wherein each wedge segment includes an inside radius formed thereon, said method comprising the steps of:

selecting a handle extension member based on available access to said bushing;

attaching said handle member to said handle extension member;

installing said set of wedge segments onto said bushing removal tool; and removing said bushing from said machine assembly.

10. The method of claim 9 wherein the step of attaching further includes the steps of:

engaging said threaded projection formed on said handle extension member within said handle member; and tightening said handle extension member within said handle member.

11. The method of claim 10 wherein the step of tightening further includes the steps of:

inserting a cylindrical pin into said cross-hole drilled through said handle extension member; and rotating said pin until a predetermined torque is obtained on said threaded projection.

12. The method of claim 9 wherein the step of installing further includes the steps of:

selecting said wedge segments based on a diameter of said bushing to be removed;

arranging said wedge segments on said pilot diameter at 90 degree intervals to form a disc-shaped subassembly;

inserting said cap screw through said longitudinal bore in said pilot stud; and advancing said cap screw into said threaded hole formed in said handle extension member to capture said wedge segments in their functional position.

13. The method of claim 9 wherein the step of removing further includes the steps of:

aligning said bushing tool with said bushing such that said wedge segments contact said bushing; and applying an axial force to said bushing removal tool such that said bushing is removed from said machine assembly.

14. The method of claim 13 wherein the step of applying is carried out by a striking tool such as a hammer.

15. A bushing removal tool comprising:

a handle member having a longitudinal axis, wherein said handle member includes a first end and a second end;

a handle extension member integrally formed in concentric relation to said handle member, wherein said handle extension includes a proximal end and a distal end, wherein said handle extension further includes a threaded hole formed in said distal end thereof;

at least one interchangeable pilot stud having a pilot diameter formed thereon, wherein said pilot stud further includes a longitudinal bore, said pilot stud being disposed in end-to-end relation to said distal end of said handle extension;

a cap screw extending through said longitudinal bore of said pilot stud, wherein said cap screw engages said threaded hole in said handle extension; and at least one set of interchangeable wedge segments, wherein said wedge segments are captured intermediate said pilot stud and said handle extension by advancing said cap screw into said handle extension to tighten said pilot stud against said wedge segments.

16. A bushing removal tool of claim 15 wherein said handle member includes a knurled gripping surface.

17. A bushing removal tool of claim 15 wherein said at least one set of interchangeable wedge segments includes four of said wedge segments radially disposed about said pilot diameter at ninety-degree intervals in a disk-shaped configuration.

18. A bushing removal tool of claim 16 wherein each of said wedge segments includes an inside radius formed thereon, wherein said inside radius is configured for mating engagement with said pilot diameter formed on said pilot stud.

* * * * *